US005603562A

United States Patent [19]

Huang

[11] Patent Number: 5,603,562

[45] Date of Patent: Feb. 18, 1997

[54] COMBINATION FAN/LAMP

[76] Inventor: Thomas M. Huang, 5649 N. Peck Rd., Arcadia, Calif. 91006

[21] Appl. No.: 392,519

[22] Filed: Feb. 23, 1995

Related U.S. Application Data

[63] Continuation-in-part of Ser. No. 387,239, Feb. 10, 1995.

[51] Int. Cl.[6] ..... F21V 33/00

[52] U.S. Cl. ..... 362/96; 362/182; 362/253; 362/221; 362/234

[58] Field of Search ..... 362/96, 183, 253, 362/221, 234, 410, 220, 225, 233, 250, 285, 287, 413, 419, 422, 431

[56] References Cited

U.S. PATENT DOCUMENTS

| | | | |
|---|---|---|---|
| 1,337,560 | 4/1920 | Kohn . | |
| 1,371,936 | 3/1921 | Rubino . | |
| 2,115,883 | 5/1938 | Sher . | |
| 2,136,254 | 11/1938 | Sargent . | |
| 2,258,731 | 10/1941 | Blumenthal . | |
| 3,711,695 | 1/1973 | Orbach | 240/4.2 |
| 4,200,904 | 4/1980 | Doan | 362/183 |
| 4,473,869 | 9/1984 | De Widt | 362/226 |
| 4,974,126 | 11/1990 | Hwang | 362/183 |

*Primary Examiner*—Ira S. Lazarus
*Assistant Examiner*—Alfred Basichas
*Attorney, Agent, or Firm*—Sheldon & Mak

[57] ABSTRACT

A combination fan/lamp includes a base, an upstanding base column on the base, a ring-shaped frame fixedly supported atop the base column for mounting a fan assembly having a motor that is spaced from the frame; a fixture column rigidly extending upwardly from the frame and having an illuminating fixture atop the fixture module column. In one configuration, the fan lamp further includes a lamphead that is supported in a desired position and orientation relative to the frame on a curvable gooseneck that projects from the frame, the gooseneck being sufficiently long for holding a full loop thereof while supporting the lamphead. In preferred configurations, modular mechanical and electrical connections are provided between the base and the frame and/or between the frame and the fixture. The fan assembly can be adjustably oriented relative to a main air path that is perpendicular to the base column. Also, the fan lamp can be provided with an oscillating fan.

29 Claims, 4 Drawing Sheets

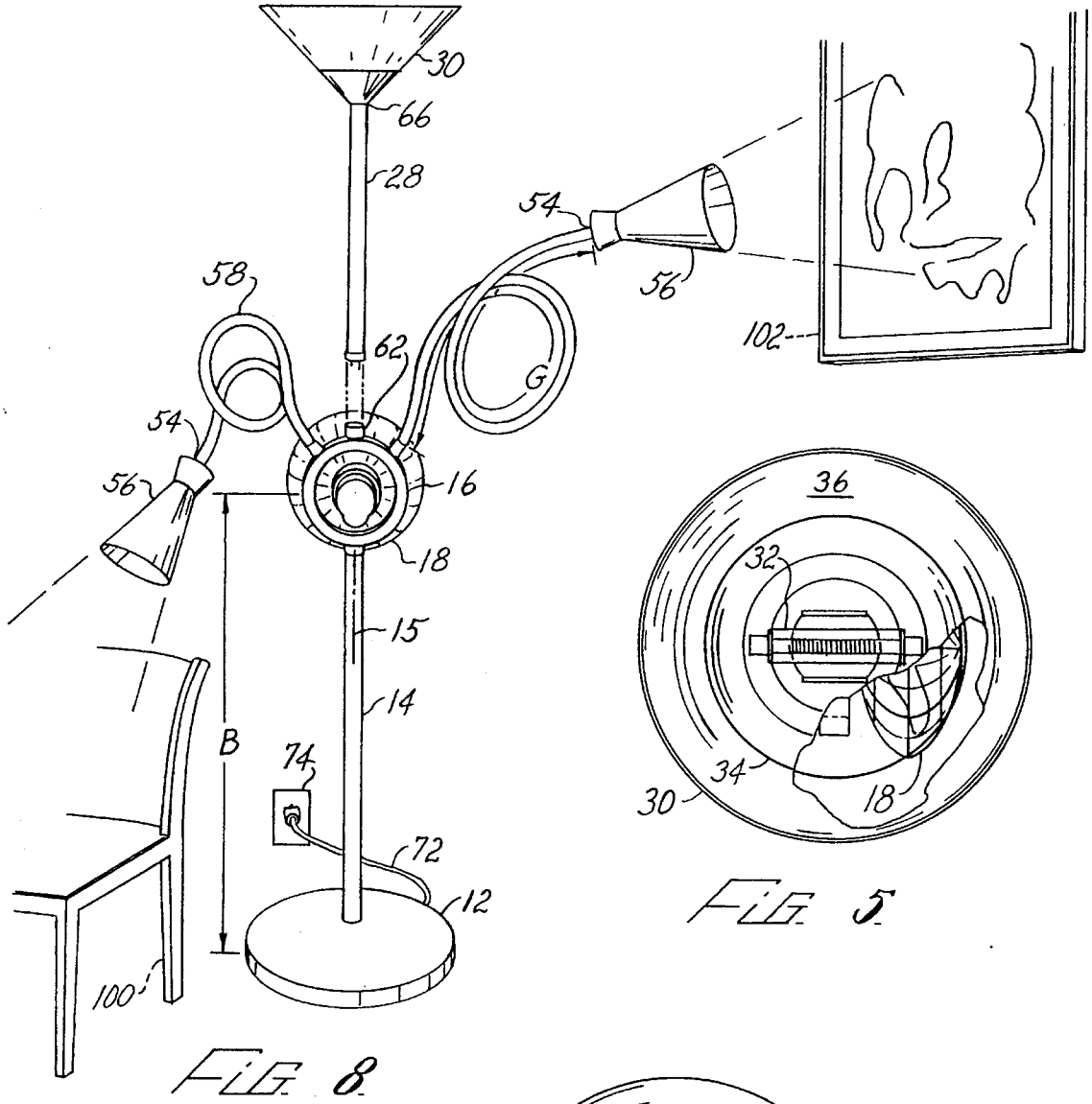
FIG. 8
FIG. 5
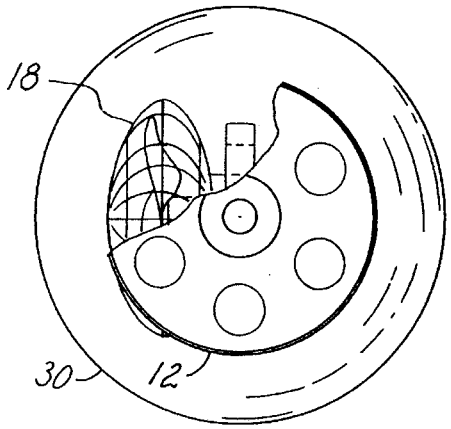
FIG. 6

COMBINATION FAN/LAMP

RELATED APPLICATION

This application is a continuation-in-part of application Ser. No. 08/387,239, filed on Feb. 10, 1995, which is incorporated herein by this reference.

BACKGROUND

The present relates to free-standing lamps and fans, and more particularly to combination fan lamps.

Combination fan lamps are know, being disclosed, for example, in U.S. Pat. Nos. 1,337,560 to Kohn, 2,115,883 to Sher, and 2,258,731 to Blumenthal. Fan lamps provide significant space savings that are particularly desirable in tight quarters. Typically, such lamps are arranged to provide a vertically and/or radially directed current of air that is heated by passage proximate the lamp.

The fan lamps of the prior exhibit a number of disadvantages. For example:

1. They are expensive to provide and difficult to service in that the fan motor is buried in supporting structure;

2. They are ineffective in that the upwardly directed air fails to circulate where it is needed, and the heated air stagnates in upper room extremities rather than circulating among occupants of the room; and 3. They are bulky and unsightly;

Thus there is a need for a fan lamp that avoids the above disadvantages.

SUMMARY

The present invention is directed to a combination fan lamp that meets this need. In one aspect of the invention, the lamp includes a base; a frame mounted in a fixed position relative to the base and having an upwardly extending conduit member; a main lamp fixture supported above the conduit member; and a fan assembly mounted to the frame, the fan assembly including a motor that is spaced from the conduit member, electrical conductors for powering at least one of the main lamp fixture and the fan assembly passing within the conduit member.

The lamp can further include an upstanding base column fixably connected to the base and having a column axis at an upper extremity thereof. The frame can be mounted to an upper extremity of the base column. The lamp can further include a fixture column rigidly connected between the frame and the main lamp fixture, the fan assembly being spaced approximately midway between the base and the main lamp fixture. The fan assembly can be spaced between approximately 30 inches and approximately 50 inches above a bottom extremity of the base.

Preferably the fan assembly is oriented for drawing and feeding air on a main air path extending generally perpendicular to the column axis. The lamp can include means for adjustably holding the fan assembly vertically inclined at an inclination angle relative to the main air path. The inclination angle can range upwardly and downwardly approximately 15° from the main air path. The lamp can include means for oscillating the fan assembly horizontally on opposite sides of the main air path. The means for oscillating is capable of panning the fan assembly up to approximately 15° on opposite sides of the main air path. The opening can be located in line with the column axis.

The lamp can further include a base electrical connector mounted in a fixed position relative to the base and having contact elements that are oriented for receiving mating contacts, the base electrical connector having electrical conductors extending therefrom for connection to an external source; a module electrical connector mounted in fixed relation to the main lamp fixture and having at least two projecting contact elements that are oriented for engagement as the mating contacts, and means for electrically connecting the main lamp fixture between the projecting contact elements; and means for removably securing the module electrical connector on the base electrical connector for powering the main lamp fixture from the external source, the means for securing including a ring member and a support element, the ring member being formed for rotatably engaging the support element, the ring member being rotatably retained relative to one of the base and the main lamp fixture, the support element being fixably located relative to the other of the base and the main lamp fixture.

The base electrical connector can be mounted proximate an upper extremity of the frame. The base electrical connector can be mounted proximate a lower extremity of the frame, the fan assembly being powered through the base electrical connector. The lamp can include first and second base electrical connectors, the first base electrical connector removably connecting the frame relative to the base and powering the main lamp fixture and the fan assembly, the second base electrical connector removably connecting the main lamp fixture relative to the frame and powering the main lamp fixture.

Preferably the ring member threadingly engages the support element, thereby releasably clamping the lamp module on the base with the contacts in mating engagement. The support element can be a threaded shell member fixedly supported proximate the upper extremity of the base, the ring member being a clamp nut that is retained on the lamp module. One of the support element and the ring member can have a plurality of radially projecting bosses formed thereon, and the other of the support element and the ring member having corresponding L-shaped channels formed therein for engaging the bosses, the bosses entering the channels axially as the ring member engages the support element, the bosses entering horizontal legs of the channels during rotation of the ring member relative to the support element.

The lamp can further include a lamphead, an elongate, curvable neck member having one end fixed relative to the base and a free end connected to the lamphead for supporting the lamphead in a desired position and orientation relative to the base, and means for electrically connecting the lamphead to the electrical conductors of the base electrical connector. Preferably the neck member is sufficiently long for holding a full loop thereof while supporting the lamphead. The neck member can have an extended length of at least 22 inches. The neck member can be hollow, the means for electrically connecting the lamphead extending within the neck member. The neck member can extend from the frame. The lamp can include at least two of the neck members supporting respective lampheads, the neck members being connected to the frame.

In another aspect of the invention, the lamp includes a base; a frame fixedly supported above the base and having a conduit portion, a fan assembly mounted in spaced relation to the conduit portion; a lamphead, an elongate, curvable neck member having one end fixed relative to the base and a free end connected to the lamphead for supporting the lamphead in a desired position and orientation relative to the frame, the neck member being sufficiently long for holding a full loop thereof while supporting the lamphead, electrical conductors for powering at least one of the fan assembly and lamphead passing within the conduit portion of the frame. The lamp can further include an upstanding base column fixably connected to the base, the base column having a column axis at an upper extremity thereof, the conductors extending within the base column. The neck member can be mounted to the frame.

The lamp can further include a base electrical connector mounted in a fixed position relative to the base and having contact elements that are oriented for receiving mating contacts, the base electrical connector having electrical conductors extending therefrom for connection to an external source, and means for electrically connecting the lamphead between the electrical conductors; a fixture module comprising a module structure, a fixture supported by the structure, a module electrical connector mounted proximate a lower extremity of the structure and having at least two projecting contact elements that are oriented for engagement as the mating contacts, and means for electrically connecting the fixture between the projecting contact elements; and means for supportively securing the fixture module on the base electrical connector for powering the fixture from the external source, the lamphead also being powered from the external source. The lamp can include at least two of the neck members supporting respective lampheads.

DRAWINGS

These and other features, aspects, and advantages of the present invention will become better understood with reference to the following description, appended claims, and accompanying drawings, where:

FIGS. 5 and 6 are top and bottom plan views of the lamp of FIG. 1;

FIG. 8 is a front elevational view showing an alternative configuration of the fan lamp of FIG. 1;

DESCRIPTION

Figure 3:
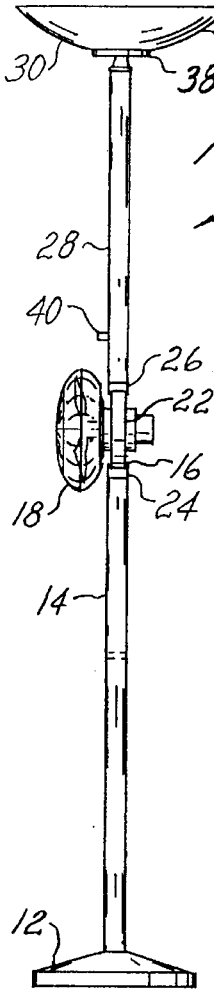
FIGS. 3 and 4 are right and left side elevational views of the lamp of FIG. 1.
Figure 4:
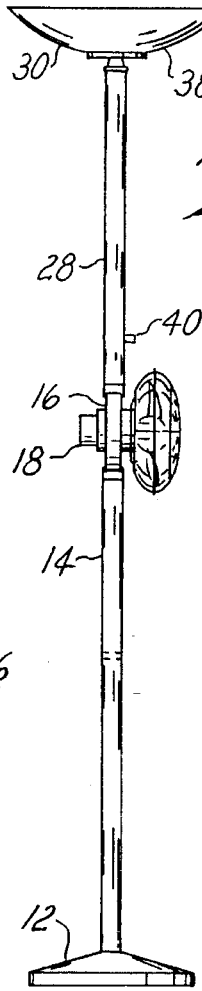

The present invention meets this need by providing a free standing combination fan lamp that is particularly suitable for use in tight quarters. With reference to FIGS. 1–7 of the drawings, a lamp 10 includes a base 12 for support on a horizontal surface such as a floor or table, a tubular base column 14 extending rigidly vertically from the base 12 on a column axis 15. According to the present invention, an open frame 16 is supported above the base 12 at an intermediate elevation on the lamp 10 for supporting a fan assembly 18. In an exemplary configuration of the lamp 10, the frame 16 forms a circular opening 20 that is aligned with the column axis 15, the frame 16 including a hollow, vertically oriented ring member 22 that is rigidly connected to a base connector 24 of the base column 14, the base connector 24 forming a rigid upper extremity of the base column 14. The ring member 22 is also connected to a column connector 26 that forms a rigid lower extremity of a fixture column 28, the column 28 extending rigidly above the frame 16 on the column axis 15 for supporting a main light fixture 30.

Figure 2:
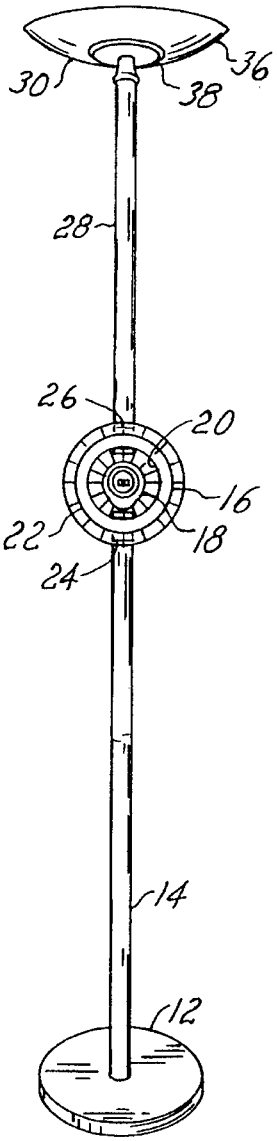
FIG. 2 is a rear elevational perspective view of the lamp of FIG. 1.

An exemplary configuration of the main light fixture 30 includes a horizontally disposed halogen illuminator bulb 32 that is supported above a vertically directed reflector 34 within a translucent bowl member 36 as shown in FIG. 5, the reflector 34 and the bowl member 36 being supported on a circular platform 38 that is attached to the fixture column 28 as best shown in FIG. 2. A control switch 40 is mounted to the fixture column 28 for selectively powering the main light fixture 30 in a conventional manner using suitable conductors (not shown) that extend within the fixture column 28.

Figure 7:
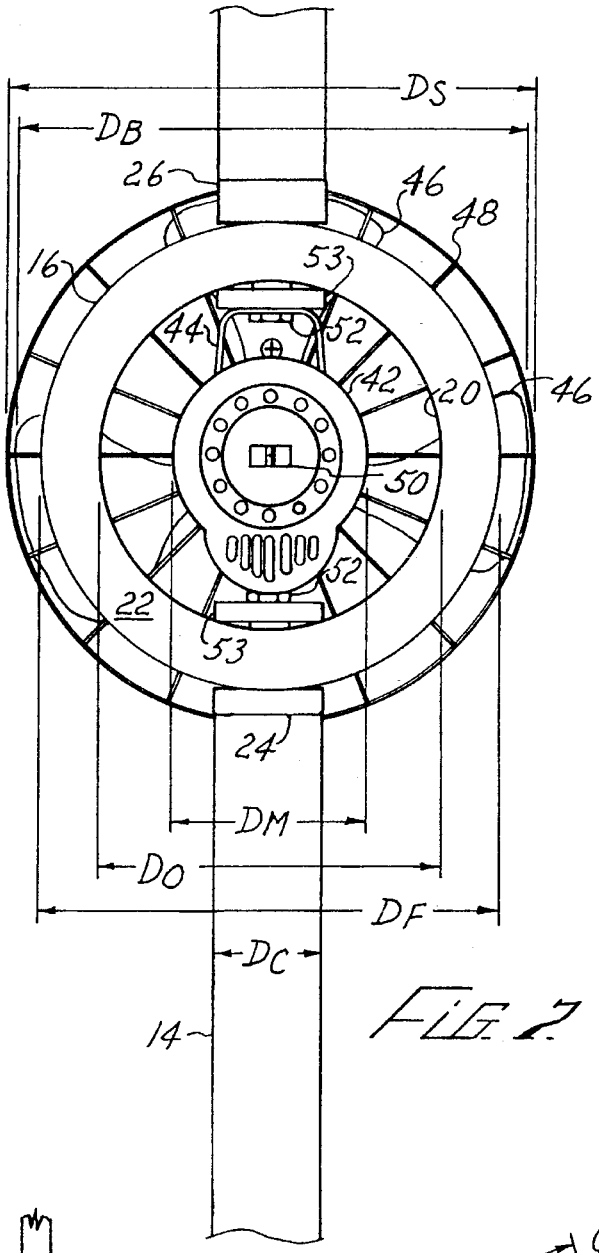
FIG. 7 is a rear elevational detail view of the lamp of FIG. 1 within region 7 of FIG. 2.

As best shown in FIG. 7, the fan assembly 18 includes a motor 42, a bracket 44 for suspending the motor 42 within the opening 20 of the frame 16, blades 46 that are rotatable by the motor for circulating air generally perpendicular to the column axis 15, and a protective cage 48 that is mounted to the motor 42 in a conventional manner for enclosing the blades 46. A fan switch 50 is located at a rear extremity of the motor 42 for controlling the fan assembly 18 in a conventional manner, suitable conductors (not shown) for powering the fan 18 and the main lamp fixture 30 extending within the base column 14 for connection to an external source.

As also shown in FIG. 7, a threaded fastener 52 extends upwardly through the bracket 44 and a spacer or block 53, the fastener 52 also extending through the ring member 22 of the frame 16 and threadingly engaging the column connector 26 for clamping bracket 44 and the column connector 26 to opposite walls of the ring member 22, the motor 42 being preferably centrally located within the opening 20. Similarly, counterparts of the fastener 52 and the spacer 53 are used for clamping the ring member 22 to the base connector 24 of the base column 14.

As further shown in FIG. 7, the shroud 48 has an outside diameter $D_S$, the blades 46 rotating within a blade diameter $D_B$ that is slightly less than $D_S$, the frame 16 having an outside frame diameter $D_F$ and an inside opening diameter $D_O$. The motor 42 has an outside diameter $D_M$ that is spaced within the opening diameter $D_O$. Preferably, the frame diameter $D_F$ is not greater than the shroud diameter $D_S$ for providing a compact appearance of the frame 16, the blades 46 being suitably spaced from the frame 16 for enabling a smooth flow of air from substantially the full extent of the blades 46 around and within the frame 16, at least a portion of the air passing within the opening 20 for cooling the motor 42 and enhancing the effectiveness of the fan assembly 18.

Figure 9:
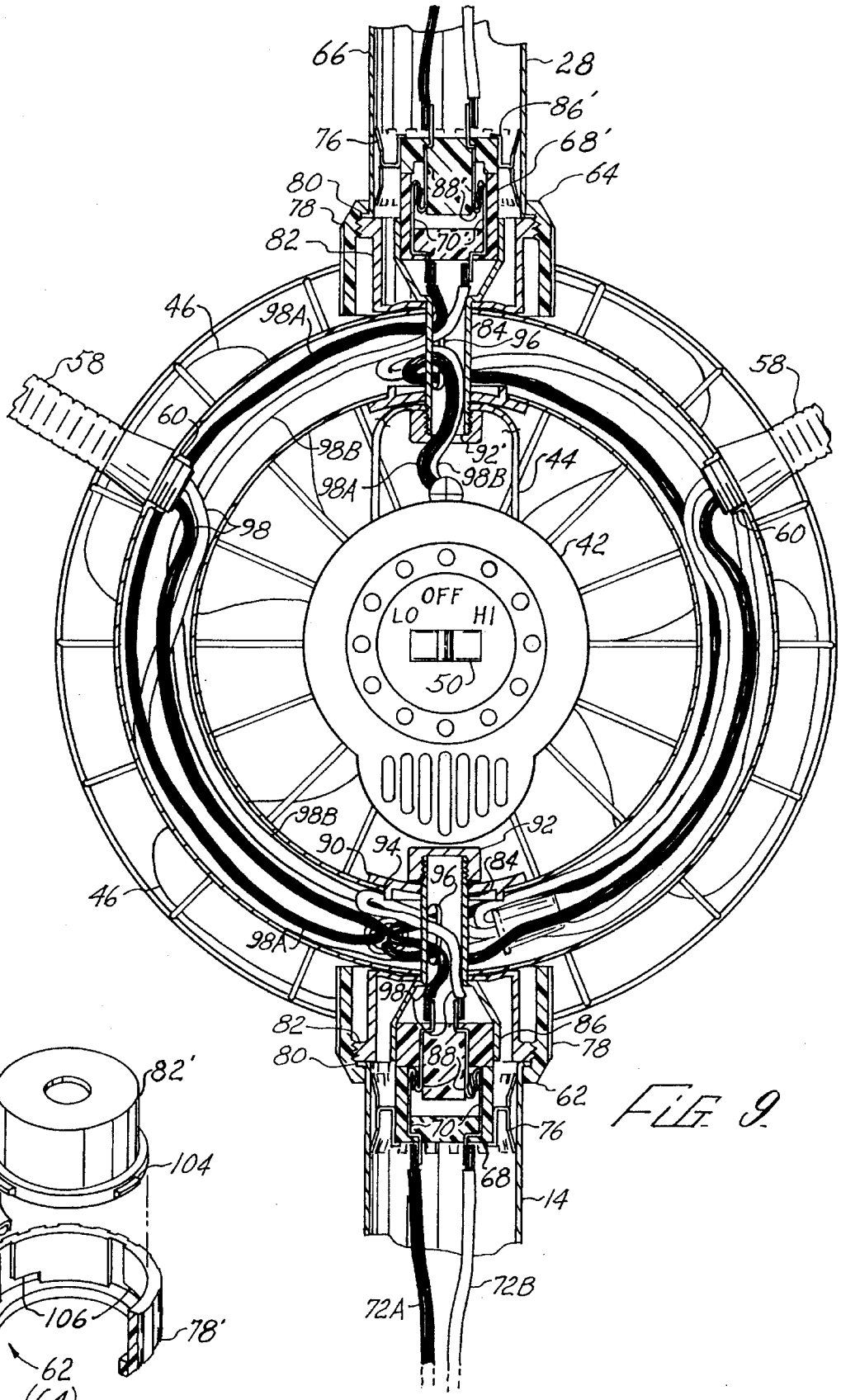
FIG. 9 is a fragmentary sectional elevational detail view of the lamp of FIG. 8 within region 9 therein.

With further reference to FIGS. 8 and 9, an alternative configuration of the fan lamp, designated 10', includes a pair of task illuminators 54, each of the task illuminators 54 including a task lamphead 56 and a curvable tubular gooseneck 58 supportively connecting the respective lamphead 56 to the frame 16. More particularly, the ring member 22 has a pair of threaded bosses 60 formed therein for rigidly connecting a lower end extremity of the gooseneck 58 to the lid member 22. An important feature of the present invention is the goosenecks 58 being sufficiently long for holding a desired shape including a full loop while supporting the respective lampheads 56. Each of the task illuminators 54 is powered by a pair of conductors 98, described below. It will be understood that switches for controlling the task illuminators can be provided at the respective task lampheads 56 or elsewhere on the fan lamp 10'.

As further shown in FIG. 9, either of the fan lamps 10 or 10' can include a modular base connection 62 between the base column 14 and the frame 16. Also or in the alternative, a modular fixture connection 64 can be provided between the frame 16 and the fixture column 28, the connections 62 and 64 including both electrical circuit paths and rigid mechanical connections to the frame 16 as described herein. The fixture connection 64 provides for removably mounting a fixture module 66 that includes the main light fixture 30 and the fixture column 28.

The base connection 62 includes a base socket 68 having a pair of recessed electrical contact elements 70 therein, the contact elements 70 being connected in a conventional manner to respective conductors 72, designated 72A and 72B in FIG. 9, the conductors 72 extending downwardly within the base column 14 for connection to an external source 74 of electrical power as shown in FIG. 8. The base socket 68 is fixably mounted proximate the upper extremity Of the base column 14 by a spring finger ring 76. The base connection 26 also includes a threaded clamp nut 78 that is rotatably located on the base column 14 for axially engaging a flange portion 80 of the base column 14, the flange portion 80 being clamped by the clamp nut 78 against a threaded shell member 82 that is rigidly connected to the frame 16.

The connection of the shell member 82 to the frame 16 is effected by a tubular clamp stem 84 of a plug member 86 that mates with the base socket 68, the plug member 86 having a pair of electrical contacts 88 that axially engage respective ones of the contact elements 70. The clamp stem 84 protrudes opposite walls of the ring member 22 and a clamp plate 90, the parts being secured by a stem nut 92, the clamp plate 90 making locating contact with an enlarged access opening 94 of the ring member 22. The clamp stem 84 also has a feed opening 96 formed therein for passing counterparts of the conductors 72 therethrough, the conductors being designated 98A and 98B, 98 collectively. The base socket 68, together with the threaded clamp nut 78 and the flange portion 80 of the base column 14, form a base connector portion of the base connection 62, being rigidly located proximate the upper extremity of the base column member 14 when the clamp nut 78 is tightened. The base connection 62 also includes the plug member 86, the electrical contacts 88, and the shell member 82.

As further shown in FIG. 9, the fixture connection 64 includes counterparts of the base socket, designated frame socket 68' having counterparts of the contact elements designated 70' (electrically connected to the conductors 98) and the clamp stem 84. A counterpart of the plug member, designated 86' and having contacts 88' is fixedly supported proximate a lower extremity of the fixture column 28 by a counterpart of the finger ring 76 for mating with the frame socket 68'. The fixture column 28 is formed with a counterpart of the flange portion 80, the fixture column 28 being rigidly connected to the frame 16 by a counterpart of the clamp nut 78. The frame socket 68' and the shell member 82 form a frame connector counterpart of the base connector portion, the plug member 86' and the clamp nut 78 also being an included part of the frame connection 64. Thus the main light fixture 30, the fixture column 28 and the associated clamp nut 78 form the fixture module 66 that can be selectively included with or omitted from the fan lamp 10'. Also, storage and transportation of the lamp 10' of the present invention is facilitated by assembly and/or disassembly of one or both of the module connections 62 and 64.

The fan assembly 18 is powered by elements of the conductors 98 that pass from within the ring member 22, through the feed opening 96, and downwardly through the clamp stem 84 of the frame connection 64 and an open counterpart of the stem nut, designated 92', the nut 92' being formed for smoothly confining the conductors 98.

As shown in FIG. 8, the fan assembly 18 is centered at a distance B above the bottom of the base member 12, each of the goosenecks 58 having a running length G. The distance B can be from approximately 30 inches to approximately 50 inches, for convenient and effective use of the fan 18 with the base 12 supported at floor level, the length G being from approximately 22 inches to approximately 36 inches for permitting the task lampheads 56 to be selectively located in a wide range of positions and orientations that can include the goosenecks 58 being curved at least one complete revolution. The goosenecks 58 can be formed of a coiled, interlocking metal strip in a conventional manner, the interlocking being produced with a sufficiently frictional fit for supporting the task lampheads 56 in desired positions and orientations as exemplified in FIG. 8. In particular, each gooseneck 58 can be curved in a single plane or in orthogonal planes, as best shown at the left side in FIG. 8.

Figure 1:
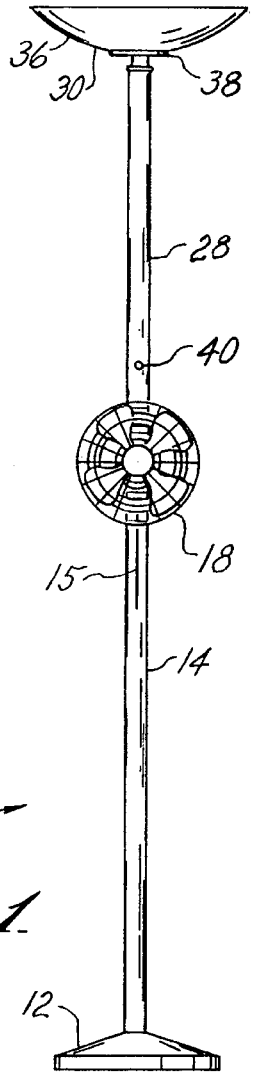
FIG. 1 is a front elevational view of a fan according to the present invention.

As shown in FIG. 1, the lamp 10' of the present invention is effective for providing area illumination by means of the main light fixture 30, reading illumination by means of one of the task lampheads 56 as indicated by a chair 100, and wall picture illumination by means of the other task lamphead 56 as indicated by a wall hanging 102, the chair 100 and the wall hanging 102 forming no part of the present invention. The lamp 10' is particularly effective in that the task lampheads 56 can be positioned and oriented effectively even with the chair 100 and the wall hanging 102 widely separated as shown in FIG. 8.

As further shown in FIG. 8, a counterpart of the clamp nut 62 can be applied to the shell member 82 when it is desired to omit the main light fixture 30 from the lamp 10, the clamp nut decoratively and protectively covering the base socket 34.

Figure 9A:
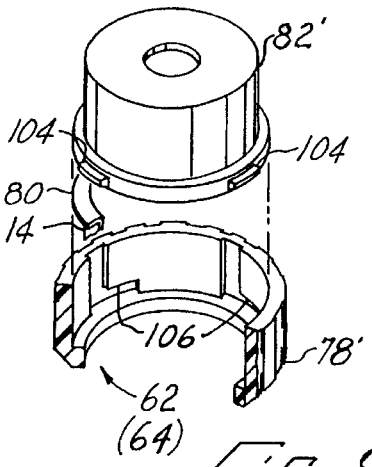
FIG. 9A is an exploded perspective view showing a shell and clamp nut portion of the lamp of FIG. 9.

With further reference to FIG. 9A, alternative configurations of the base connection 62 and/or the fixture connection 64 can have "twist-lock" engagement. A counterpart of the shell member, designated 82', has at least two projecting bosses 104 formed thereon for engaging corresponding L-shaped channels 106 that are formed in a clamp nut, designated 78'. The L-shaped channels 106 permit axial engagement of the nut 78' over the bosses 104, the flange portion 80 being clamped against the shell member 82' when the clamp nut 52 is rotated for moving the bosses 104 into horizontal leg portions of the respective channels 106.

Figure 10:
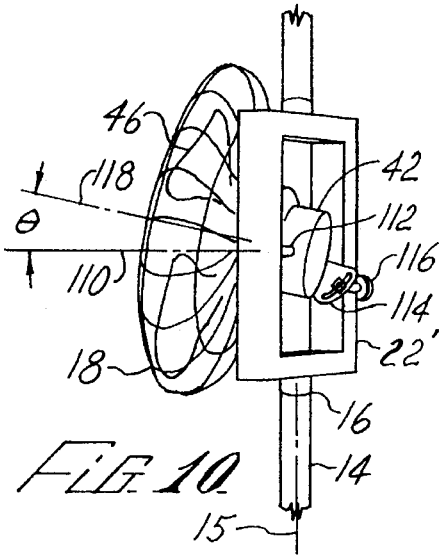
FIG. 10 is an elevational perspective view showing an alternative configuration of the lamp of FIG. 7.

With further reference to FIG. 10, an alternative configuration of the fan lamp 10 can have the fan assembly 18 mounted for adjustment of fan inclination on opposite sides of a main air path 110 by an angle θ, the main air path being generally perpendicular to the column axis 15. More particularly, the motor 42 is pivotably mounted to a counterpart of the ring member, designated 22' by a pair of axle members 112 that extend rigidly on opposite sides of the motor 42, one of the axle members 112 having a slotted clamp plate 114 rigidly attached thereto for engagement by a screw clamp 116 that is rotatably located on the frame 16. Thus a shaft axis 118 of the fan 18 can be selectively maintained at the desired angle θ relative to the main air path 110. Normally, the axle members extend horizontally from the motor 42, the shaft axis being adjustable above and below the (horizontal) main air path 110, the main air path 110 being perpendicular to the column axis 15. It will be understood that other orientations of the axle members 112 can be utilized for permitting different directions of adjustment of the shaft axis 118. As also shown in FIG. 10, the ring member 22 of the frame 16 can have a rectangular rather than circular configuration. Other shapes such as triangular are possible, in addition to open configurations such as C-shaped. Preferably the motor 42 is spaced from the frame 16 in any of the configurations thereof for permitting free air flow between the frame 16 and the motor 42, and for facilitating adjustable orientation of the shaft axis 110 of the fan assembly 18 as described above and/or oscillating orientation as described below.

Figure 11:
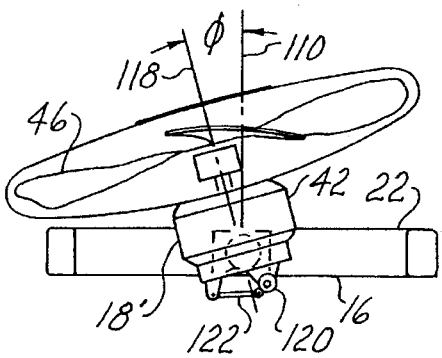
FIG. 11 is a plan sectional view of the lamp of FIG. 10.

With further reference to FIG. 11, the fan lamp 10 can also be provided with an oscillating fan, designated 18'. The oscillating fan 18' has a control knob 120 for selectively activating a conventional eccentric arm mechanism 122, the fan 18' being operable in a stationary orientation or oscillating through an angle ø on opposite sides of the main air path 110.

Although the present invention has been described in considerable detail with reference to certain preferred versions thereof, other versions are possible. For example, the frame 16 can be located proximate the base member 12, omitting the base column member 14. Also, the base column member 14 can be curved, the column axis 15 being taken proximate the upper end of the base column member 14. Further, either or both of the connector 62 and 64 can be oriented at an angle offset from the column axis 15 (side engagement). One or more of the goosenecks 58 can be attached directly to either the base column member 14 or the fixture column 28. Moreover, other powered fixtures such as heaters can be substituted for the main light fixture 30 and/or the task lampheads 56. Therefore, the spirit and scope of the appended claims should not necessarily be limited to the description of the preferred versions contained herein.

What is claimed is:

1. A free standing combination fan lamp comprising:

(a) a base;

(b) an upstanding base column fixably connected to the base and having a column axis extending from an upper extremity of the column;

(c) a frame mounted in a fixed position relative to the base and having an upwardly extending conduit member;

(d) a main lamp fixture supported above the conduit member;

(e) a fan assembly mounted to the frame, the fan assembly including a motor, the motor being spaced from the conduit, an opening being formed between opposite sides of the frame for the passage of air through the fan between the motor and the conduit, electrical conductors for powering at least one of the main lamp fixture and the fan assembly passing within the conduit member, the fan assembly being oriented for drawing and feeding air along a main air path extending generally perpendicular to the column axis; and (f) means for moving the fan assembly relative to the frame.

2. The lamp of claim 1, wherein the frame is mounted to an upper extremity of the base column.

3. The lamp of claim 1, further comprising a fixture column rigidly connected between the frame and the main lamp fixture, the fan assembly being spaced approximately midway between the base and the main lamp fixture.

4. The lamp of claim 3, wherein the fan assembly is spaced between 30 inches and 50 inches above a bottom extremity of the base.

5. The lamp of claim 1, wherein the means for moving the fan assembly further comprises means for adjustably holding the fan assembly vertically inclined at an inclination angle relative to the main air path.

6. The lamp of claim 5, wherein the inclination angle can range upwardly and downwardly approximately 15° from the main air path.

7. The lamp of claim 1, wherein the means for moving the fan assembly further comprises means for oscillating the fan assembly horizontally on opposite sides of the main air path.

8. The lamp of claim 7, wherein the means for oscillating is capable of panning the fan assembly up to approximately 15° on opposite sides of the main air path.

9. A free standing combination fan lamp comprising:

(a) a base;

(b) an upstanding base column fixably connected to the base and having a column axis extending from an upper extremity of the column;

(c) a frame mounted in a fixed position relative to the base and having an upwardly extending conduit member, the frame comprising a ring portion including the conduit member, the ring portion defining an opening between opposite sides of the frame;

(d) a main lamp fixture supported above the conduit member;

(e) a fan assembly mounted to the frame, the fan assembly including a motor, the motor being spaced within the opening defined by the ring portion of the frame for the passage of air through the fan between the motor and the conduit, electrical conductors for powering at least one of the main lamp fixture and the fan assembly passing within the conduit member.

10. The lamp of claim 9, wherein the opening is located in line with the column axis.

11. A free standing combination fan lamp comprising:

(a) a base;

(b) a frame mounted in a fixed position relative to the base and having an upwardly extending conduit member;

(c) a main lamp fixture supported above the conduit member; and (d) a fan assembly mounted to the frame, the fan assembly including a motor, the motor being spaced from the conduit, an opening being formed between opposite sides of the frame for the passage of air through the fan between the motor and the conduit, electrical conductors for powering at least one of the main lamp fixture and the fan assembly passing within the conduit member;

(e) a base electrical connector mounted in a fixed position relative to the base and having contact elements, the contact elements being oriented for receiving mating contacts, the base electrical connector having electrical conductors extending therefrom for connection to an external source;

(f) a module electrical connector mounted in fixed relation to the main lamp fixture and having at least two projecting contact elements, the projecting contact elements being oriented for engagement as the mating contacts, and means for electrically connecting the main lamp fixture between the projecting contact elements; and (g) means for removably securing the module electrical connector on the base electrical connector for powering the main lamp fixture from the external source, the means for securing comprising a ring member and a support element, the ring member being formed for rotatably engaging the support element, the ring member being rotatably retained relative to one of the base and the main lamp fixture, the support element being fixably located relative to the other of the base and the main lamp fixture.

12. The lamp of claim 11, wherein the base electrical connector is mounted proximate an upper extremity of the frame.

13. The lamp of claim 11, wherein the base electrical connector is mounted proximate a lower extremity of the frame, the fan assembly being powered through the base electrical connector.

14. The lamp of claim 13, comprising first and second base electrical connectors, the first base electrical connector removably connecting the frame relative to the base and powering the main lamp fixture and the fan assembly, the second base electrical connector removably connecting the main lamp fixture relative to the frame and powering the main lamp fixture.

15. The lamp of claim 11, wherein the ring member threadingly engages the support element, thereby releasably clamping the lamp module on the base with the contacts in mating engagement.

16. The lamp of claim 15, wherein the support element is a threaded shell member fixedly supported proximate the upper extremity of the base, the ring member being a clamp nut that is retained on the lamp module.

17. The lamp of claim 11, wherein one of the support element and the ring member has a plurality of radially projecting bosses formed thereon, and the other of the support element and the ring member having corresponding L-shaped channels formed therein for engaging the bosses, the bosses entering the channels axially as the ring member engages the support element, the bosses entering horizontal legs of the channels during rotation of the ring member relative to the support element.

18. A free standing combination fan lamp comprising:

(a) a base;

(b) a frame mounted in a fixed position relative to the base and having an upwardly extending conduit member;

(c) a main lamp fixture supported above the conduit member; and (d) a fan assembly mounted to the frame, the fan assembly including a motor, the motor being spaced from the conduit, an opening being formed between opposite sides of the frame for the passage of air through the fan between the motor and the conduit, electrical conductors for powering at least one of the main lamp fixture and the fan assembly passing within the conduit member; and (e) a lamphead assembly, including a lamphead, an elongate, curvable neck member having one end fixed relative to the base and a free end connected to the lamphead for supporting the lamphead in a desired position and orientation relative to the base, and means for electrically connecting the lamphead to the electrical conductors of the base electrical connector.

19. The lamp of claim 18, wherein the neck member is sufficiently long for holding a full loop thereof while supporting the lamphead.

20. The lamp of claim 19, wherein the neck member has an extended length of at least 22 inches.

21. The lamp of claim 18, wherein the neck member is hollow, the means for electrically connecting the lamphead extending within the neck member.

22. The lamp of claim 18, wherein the neck member extends from the frame.

23. The lamp of claim 22, comprising at least two of the neck members supporting respective lampheads, the neck members being connected to the frame.

24. A free-standing combination fan lamp comprising:

(a) a base;

(b) a frame fixedly supported above the base and having a conduit portion, a fan assembly mounted in spaced relation to the conduit portion;

(c) a lamphead, an elongate, curvable neck member having one end fixed relative to the base and a free end connected to the lamphead for supporting the lamphead in a desired position and orientation relative to the frame, the neck member being sufficiently long for holding a full loop thereof while supporting the lamphead, electrical conductors for powering at least one of the fan assembly and the lamphead passing within the conduit portion of the frame.

25. The lamp of claim 24, further comprising an upstanding base column fixably connected to the base, the base column having a column axis at an upper extremity thereof, the conductors extending within the base column.

26. The lamp of claim 25, wherein the neck member is mounted to the frame.

27. The lamp of claim 24, further comprising:

(a) a base electrical connector mounted in a fixed position relative to the base and having contact elements, the contact elements being oriented for receiving mating contacts, the base electrical connector having electrical conductors extending therefrom for connection to an external source, and means for-electrically connecting the lamphead between the electrical conductors;

(b) a fixture module comprising a module structure, a fixture supported by the structure, a module electrical connector mounted proximate a lower extremity of the structure and having at least two projecting contact elements, the projecting contact elements being oriented for engagement as the mating contacts, and means for electrically connecting the fixture between the projecting contact elements; and (c) means for supportively securing the fixture module on the base electrical connector for powering the fixture from the external source, the lamphead also being powered from the external source.

28. The lamp of claim 24, comprising at least two of the neck members supporting respective lampheads.

29. A free standing combination fan lamp comprising:

(a) a base, an upstanding base column fixably connected to the base and having a column axis proximate an upper extremity thereof;

(b) a frame fixedly supported proximate the upper extremity of the base column, the frame having a vertically extending ring portion, a substantially circular opening extending horizontally through the ring portion in line with the column axis;

(c) a main lamp fixture supported above the ring portion, the main lamp fixture including a fixture column, the fixture column being aligned on the column axis; and (d) a fan assembly mounted to the frame, the fan assembly including a motor, the motor being spaced within the opening, the fan assembly being oriented for blowing air through the opening.

* * * * *